United States Patent [19]

Shulman

[11] Patent Number: 5,054,211

[45] Date of Patent: Oct. 8, 1991

[54] HAIR DRYER ATTACHMENT FOR CREATING AN ORBITING STREAM OF AIR

[76] Inventor: Burt H. Shulman, 4-203 Village Park Apartments, Pleasant Valley, N.Y. 12569

[21] Appl. No.: 608,696

[22] Filed: Nov. 5, 1990

[51] Int. Cl.[5] ..... A45D 20/00

[52] U.S. Cl. ..... 34/97; 392/379; 239/581.1; 34/96

[58] Field of Search ..... 34/96, 97, 3, 243 R; 392/379, 380, 383, 384, 385; 239/455, 456, 569, 581.1, 581.2, 518

[56] References Cited

U.S. PATENT DOCUMENTS

| | | | |
|---|---|---|---|
| 3,943,329 | 3/1976 | Hlavac | 34/96 |
| 4,019,260 | 4/1977 | Levy et al. | 34/97 |
| 4,232,454 | 11/1980 | Springer | 392/380 |
| 4,316,077 | 2/1982 | Carlson | 34/97 |
| 4,525,623 | 6/1985 | Da Silva | 34/96 |
| 4,602,146 | 7/1986 | Barns et al. | 34/96 |

*Primary Examiner*—Albert J. Makay
*Assistant Examiner*—Denise L. F. Gromada
*Attorney, Agent, or Firm*—Haynes N. Johnson

[57] ABSTRACT

An attachment for a hair dryer, to be secured to the outlet end of the hair dryer, to cause air coming from the hair dryer to orbit and diverge, includes a tubular housing having air inlet and air outlet ends, means associated with the air inlet end to secure the housing to the air outlet of a hair dryer, an air deflector within the housing proximate to the air outlet end, the air deflector being mounted for rotation about an axis parallel to the longitudinal axis of the housing, the deflector including opposed angle vanes on the end thereof nearest the air inlet and having an angled deflector on the end thereof nearest the air outlet, so that air from the dryer passing through the housing will flow past the opposed angled vanes and cause the air deflector to rotate and the air will thereafter be orbitally deflected to one side by the angled deflector. Alternatively, the air deflector can be mounted in a hair dryer itself near the air outlet end.

9 Claims, 1 Drawing Sheet

Fig. 1.
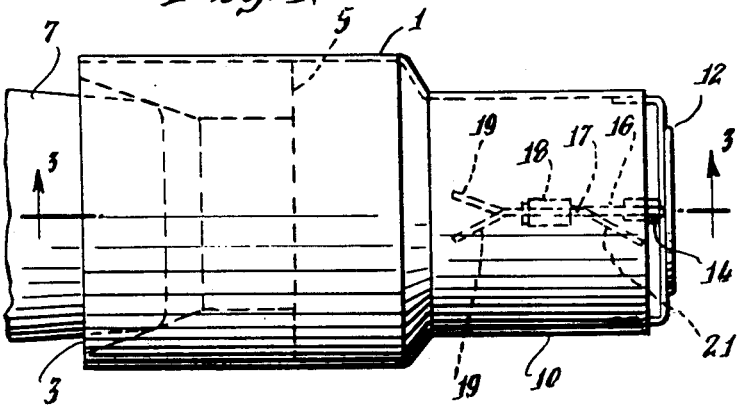
Fig. 2.
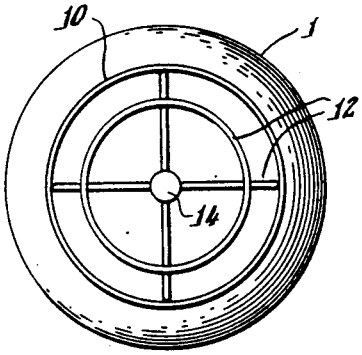
Fig. 3.
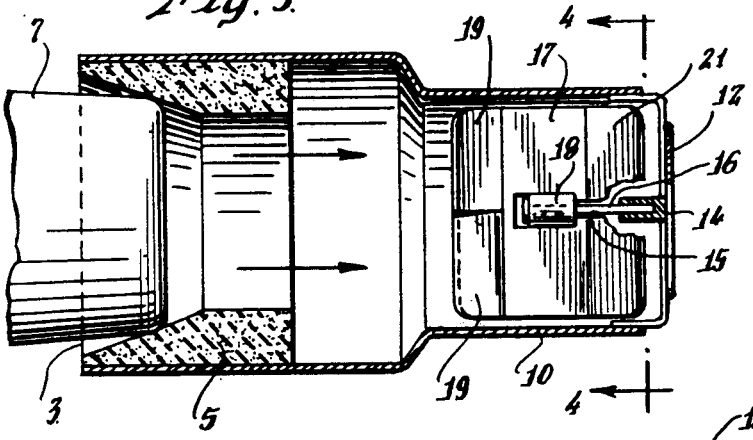
Fig. 4.
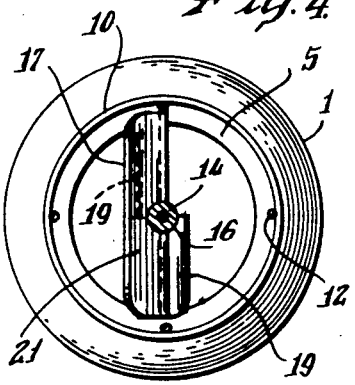
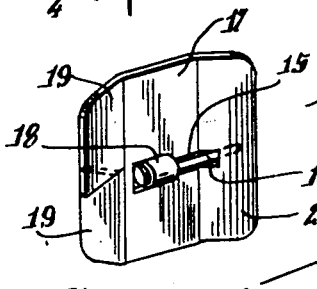
Fig. 5.
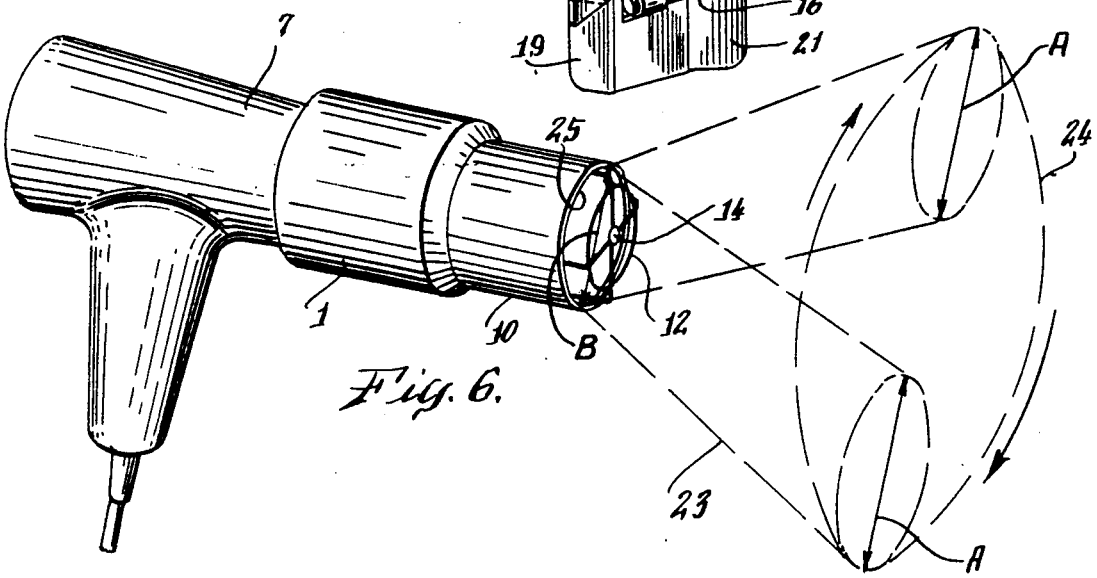
Fig. 6.

HAIR DRYER ATTACHMENT FOR CREATING AN ORBITING STREAM OF AIR

FIELD OF THE INVENTION

This invention relates to the field of personal care appliances, in particular, hair dryers. It provides an attachment for such dryers which causes the air to orbit and diverge.

BACKGROUND OF THE INVENTION

When drying one's hair with a hair dryer, the force of the airstream sometimes causes the hair to mat; and the concentrated airstream overheats the area of impingement. When this occurs, the user often keeps the dryer in constant, somewhat oscillatory, motion to spread the airstream and agitate the hair.

Prior art attempts to solve this problem have involved a periodic blocking of the air, reducing the volumetric flow rate. For example, Lee U.S. Pat. No. 4,132,360 uses a continuously rotating blocking blade to cause pulsations. Levy et al. U.S. Pat. No. 4,019,260 a vertically mounted flexible sheet is mounted in the air stream which, in effect, flaps in the breeze and, so, partially blocks and pulses the air. Another patent, Tomaro U.S. Pat. No. 4,295,283, includes a freely-rotating fan blade in the air stream to diffuse the flow of air. The prior art does not appear to orbit the airstream, and, so, if desired, this must be done by the user.

BRIEF SUMMARY OF THE INVENTION

The attachment of my invention is a generally tubular structure, one end of which mounts on the outlet of a hair dryer. All of the outlet air passes through the attachment and is caused to move in a generally diverging circular orbit as it leaves through the output end; and this orbit diameter will be considerably larger than the air stream issuing from the typical dryer. Thus the air has a motion which tends to match the motion that users have applied when using dryers to avoid matting and to provide uniform drying.

An air deflector is mounted within the air stream proximate to the air outlet of the attachment. The deflector, a sheet of stiff metal or plastic, is pivoted centrally about an axis parallel to the direction of air flow. It has a pair of oppositely directed vanes on its upstream end, so that the air stream causes the deflector to rotate. Its downstream end is a vane bent away from the axis in one direction so that it serves to deflect the air in one direction. Since the deflector is rotating, the direction of air deflection caused by the outer vane also rotates. This produces an orbiting and diverging effect similar to the rotary motion users would formerly apply to the entire dryer. Since the user no longer has to do this, drying one's hair is less tiring, and wear on the dryer bearings is reduced.

Alternatively, of course, the air deflector can be incorporated within the dryer itself.

DESCRIPTION OF THE DRAWINGS

FIG. 1 is a side elevation of my hair dryer attachment.

FIG. 2 is an end view showing the outlet end of my attachment.

FIG. 3 is a section taken on line 3—3 of FIG. 1.

FIG. 4 is an end view showing the inlet end of my attachment.

FIG. 5 is a perspective view of the deflector itself.

FIG. 6 is a perspective view of the attachment mounted on a hair dryer, showing the pattern of air motion.

DETAILED DESCRIPTION OF THE INVENTION

My dryer attachment 1 is shown in FIG. 1. It is a generally tubular unit with its inlet section 3 having a greater outside diameter than its outlet section 10. This is so that the inlet section can hold a ring 5 of flexible foam material to receive and hold various dryer barrel diameters. Ring 5 can be beveled on its inner entry surface to more readily receive the dryer barrel.

Preferably the inner diameter of the dryer outlet 7 (shown partially inserted) is slightly less than the inner diameter of outlet section 10 so that the air can best be rotated and deflected in that section. For example, in one unit I have made the inner diameter of the ring about 1.5 inches and that of the outlet attachment section about 1.8 inches.

An outlet grille 12 is located at the outer, downstream end of the outlet section 10. It includes a post receptacle 14 at the center of its inside surface.

An air deflector 17 is mounted within outlet section 10. It has a longitudinal slot 15 within which is fitted an axial post 16 and inner bearing member 18. Post 16 is mounted in receptacle 14, allowing the deflector 17 to rotate about the axis of the post. Deflector 17 includes opposed angled vanes 19 on its upstream end, the vanes having an angle to the axis of about 25°. At its downstream end it has a single angled deflector 21 on one side of the axis, at an acute angle of about 30° to the axis. The downstream end of the angled deflector 21 should be close to grille 12, almost contiguous, so that the cone of outlet air will not be narrowed by the inside of outlet section 10.

The intent and result of this configuration is to cause the deflector to rotate at relatively constant speed as varying air speeds are generated by the dryer blower due to different speed settings. The reason for this is the balance between the torque produces by the drive vanes 19 and that required by the angled deflector 21 due to the angular momentum change used to orbit the airstream. Since both of these effects are proportional to airstream velocity and oppose each other, rotational speed stays relatively constant and optimal.

It can now be seen that air flow through my attachment 1 first flows past vanes 19 and causes the deflector 17 to rotate. It then flows past the angled deflector 21 and is aerodynamically deflected to one side. Since deflector 17 is rotating, the air being deflected moves in a circular orbit. This orbiting conical and diverging pattern is indicated by numeral 23 in FIG. 6. The air column which exits the dryer with a diameter B is rotated so as to move in a circular pattern as indicated by the larger diameters A in FIG. 6. Circumferences 24 and 25 show the substantial increase in air pattern caused by the attachment.

It will be appreciated that my invention can also be incorporated in the hair dryer itself. In this instance the deflector 17 would be located within the dryer near its outlet 7 and after any heating units. The post 16 of deflector 17 would then be mounted in a receptacle formed on the inner surface of the outlet grille of the dryer.

I claim:

1. An attachment for a hair dryer, to be secured to the outlet end of said hair dryer, to deflect and orbit air coming from the hair dryer, said attachment including a tubular housing having air inlet and air outlet ends, means associated with said air inlet end to secure said housing to a hair dryer, an air deflector within said housing proximate to said air outlet end, means for mounting said air deflector for rotation about an axis parallel to the longitudinal axis of said housing, said defector including opposed angle vanes on the end thereof nearest said air inlet and having an angled defector on the end thereof nearest said air outlet, whereby air from said dryer passing through said housing will flow past said opposed angled vanes and cause said air deflector to rotate and the air will thereafter be deflected to one side and orbited by said rotating angled deflector.

2. An attachment for a hair dryer as set forth in claim 1 in which said means for mounting said air deflector includes a grille mounted at said air outlet, said grille including a receptacle centrally located on the inner surface of said grille, and in which said air deflector includes a mounting post fitted into said receptacle.

3. An attachment for a hair dryer as set forth in claim 2 in which the downstream end of said air deflector is proximate to said grille.

4. An attachment for a hair dryer as set forth in claim 1 in which said angled deflector is entirely to one side of said axis.

5. An attachment for a hair dryer as set forth in claim 1 in which the diameter of the orbiting air stream is greater than the diameter of the air stream entering said attachment.

6. Air deflection means for use with a hair dryer and adapted to give the air stream coming from said hair dryer an orbiting and diverging flow, said air deflection means including an air deflector within said air stream, means for mounting said air deflector for rotation about an axis parallel to the direction of said air stream, said deflector including opposed angle vanes on the upstream end thereof and having an angled deflector on the downstream end thereof, whereby said air deflector will rotate in said air stream and air exiting from said hair dryer will be orbiting and diverging.

7. Air deflection means as set forth in claim 6 in which said angled deflector is on one side of said axis and at an acute angle thereto.

8. Air deflection means as set forth in claim 6 in which said angled vanes produce a torque which substantially balances the torque required by said angled deflector, whereby the speed of rotation of said air deflector remains substantially constant for different speeds of air flow.

9. An attachment for a hair dryer, to be secured to the outlet end of said hair dryer, to deflect and orbit air coming from the hair dryer, said attachment including a tubular housing having air inlet and air outlet ends, means associated with said air inlet end to secure said housing to a hair dryer, an air deflector within said housing proximate to said air outlet end, means for mounting said air deflector for rotation about an axis parallel to the longitudinal axis of said housing, said air deflector including opposed angle vanes on the end thereof nearest said air inlet and having an angled deflector on the end thereof nearest said air outlet, and said opposed angled vanes being at an angle to said axis of about 25°, and said angled deflector being to one side of said axis and at an angle to said axis of about 30°, whereby air from said dryer passing through said housing will flow past said opposed angled vanes and cause said air deflector to rotate and the air will thereafter be deflected to one side and orbited by said rotating angled deflector.

* * * * *